US006368487B1

(12) United States Patent
Huber et al.

(10) Patent No.: US 6,368,487 B1
(45) Date of Patent: Apr. 9, 2002

(54) ELECTROLYTIC CELL FOR PRODUCING AN ALKALI METAL

(75) Inventors: Günther Huber, Ludwigshafen; Hermann Pütter, Neustadt; Kerstin Schierle-Arndt, Mannheim; Dieter Schläfer, Ludwigshafen; Josef Guth, Freinsheim, all of (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/589,163

(22) Filed: Jun. 8, 2000

(30) Foreign Application Priority Data

Jun. 11, 1999 (DE) ..... 199 26 724

(51) Int. Cl.[7] ..... C25C 3/02

(52) U.S. Cl. ..... 205/406; 205/407; 204/220; 204/221

(58) Field of Search ..... 205/407, 406, 205/560–614; 204/220, 221

(56) References Cited

U.S. PATENT DOCUMENTS 4,156,635 A * 5/1979 Cooper et al. ..... 205/407

5,951,843 A * 9/1999 Itoh et al. ..... 205/560

FOREIGN PATENT DOCUMENTS

GB 1 155 927 6/1969

OTHER PUBLICATIONS

W. Büchner et al. "Industrielle Anorganische Chemie" Metalle Und ihre Verbingungen (1981) pp. 228–229, No month avail.

Ullmann's Encyclopedia of Industrial Chemistry, Sixth Edition, (1999), Potassium and Potassium Alloys, No month avail.

* cited by examiner

*Primary Examiner*—Kathryn Gorgos
*Assistant Examiner*—Wesley A. Nicolas
(74) *Attorney, Agent, or Firm*—Keil & Weinkauf

(57) ABSTRACT

An electrolytic cell comprises an agitated, alkali metal amalgam-containing anode, an alkali metal ion-conducting solid electrolyte and a cathode, wherein the solid electrolyte and the cathode are separated from one another by a liquid electrolyte.

14 Claims, 2 Drawing Sheets

ELECTROLYTIC CELL FOR PRODUCING AN ALKALI METAL

Figure 1:
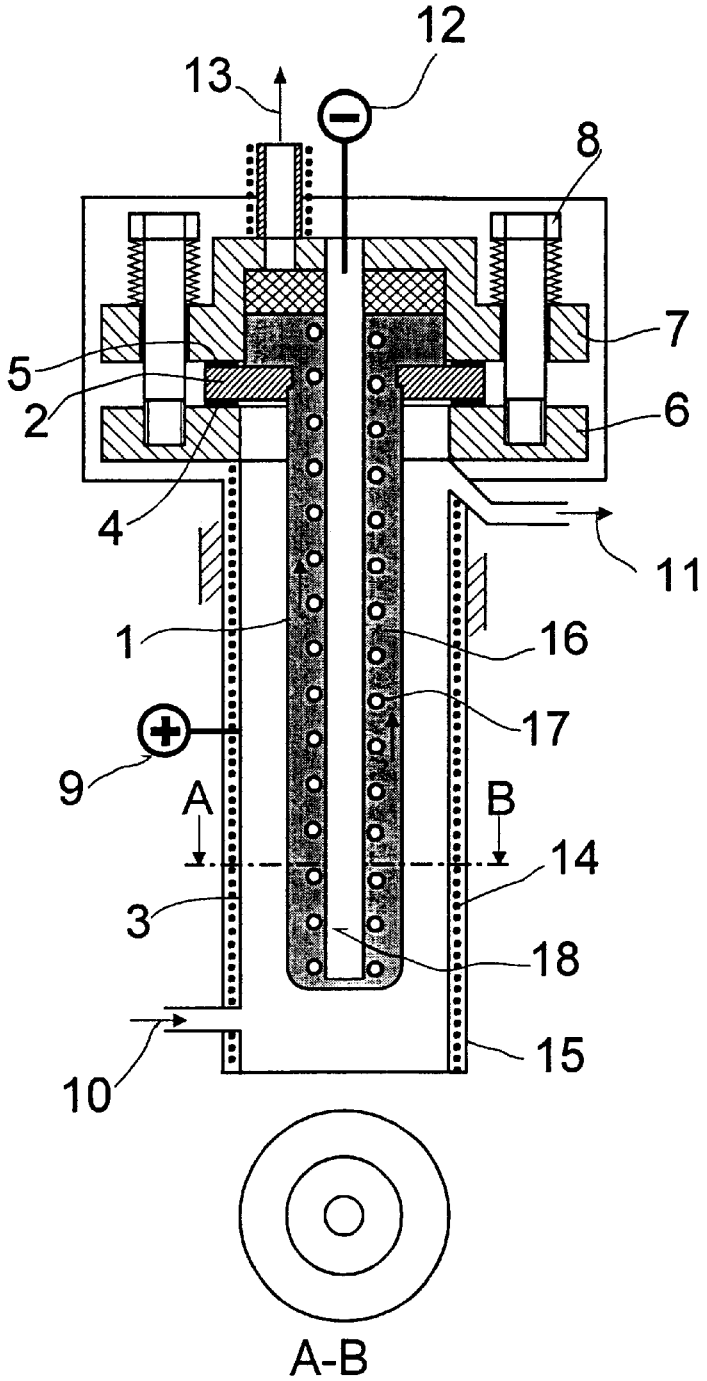

The present invention relates to an electrolytic cell which can be used for electrochemically producing alkali metal from alkali metal amalgam, where for the purpose of the invention the term "alkali metal" denotes sodium and potassium.

The invention further relates to a process for electrochemically preparing alkali metal from alkali metal amalgam, employing said electrolytic cell.

Sodium is an important inorganic basic product which is used, for example, to prepare sodium amide, sodium alcoholates and sodium borohydride. It is produced industrially via the Downs process by electrolysis of fused sodium chloride. This process has a high energy consumption of ≧10 kWh/kg of sodium (Büchner et al., Industrielle Anorganische Chemie [Industrial inorganic chemistry], 2nd Edition, Verlag Chemie, p. 228 et seq.). Moreover, the process has the serious drawback that the electrolytic cells, when switched off, are destroyed owing to solidification of the salt melt. Furthermore, the sodium metal obtained via the Downs process has the drawback that for reasons inherent to the process it is contaminated with calcium whose residual level can merely be reduced by subsequent purification steps, but can never be entirely eliminated.

Potassium likewise is an important inorganic basic product which is used, for example, for preparing potassium alcoholates, potassium amides and potassium alloys. These days it is prepared on an industrial scale in particular by reduction of potassium chloride with sodium. In the first instance this produces NaK which is then subjected to fractional distillation. A good yield is achieved by potassium vapor being continuously removed from the reaction zone, thus shifting the equilibrium to the potassium side (Ullmann's Encyclopedia of Industrial Chemistry, 6th Edition 1998, Electronic Release) . A drawback is that the process is operated at high temperature (870° C.). Moreover, the potassium formed contains about 1% of sodium as an impurity and therefore requires additional purification by a further rectification. The biggest drawback is that the sodium used is expensive. One of the reasons for this is that sodium is produced industrially via the Downs process by electrolysis of fused sodium chloride, requiring an energy input of at least 10 kWh/kg of sodium. This corresponds to about 5.3 kWh/kg of potassium (assuming a yield of 100%).

Sodium amalgam and potassium amalgam are intermediates which are produced in large quantities by chlor-alkali electrolysis using the amalgam process and which, as a rule, immediately after they have been prepared are converted, using water, into aqueous alkali metal hydroxide solution. The alkali metal-depleted or alkali metal-free alkali metal amalgam is normally immediately recycled into the chlor-alkali electrolysis. To maintain the sodium amalgam as a liquid, the sodium concentration of this solution must be kept to values of less than 1 wt %, preferably to values in the range of from 0.2 to 0.5 wt %. To maintain a potassium amalgam as a liquid, the potassium concentration of the solution is less than 1.5 wt %, preferably in the range of from 0.3 to 0.6 wt %. The amalgams produced on an industrial scale essentially contain metallic impurities such as, for example, copper, iron, potassium (in sodium amalgam), sodium (in potassium amalgam), lead and zinc in concentration ranges of from 1 to 30 ppm.

GB 1,155,927 describes a process according to which, employing a solid sodium ion conductor such as e.g. $\beta$-$Al_2O_3$, employing amalgam as the anode and sodium as the cathode, sodium metal can be produced electrochemically from sodium amalgam. Implementation of the process described in GB 1,155,927 does not, however, lead to the results described therein regarding sodium throughput, product purity and current density. Moreover, the system described therein exhibits unstable behavior within a few days if the temperature range claimed is adhered to.

Electrolytic cells which are used in an electrochemical process for preparing alkali metal from alkali metal amalgam and which include a solid ion conductor are often unsuitable for long-term continuous operation. One of the reasons for this is that the solid ion conductor becomes mechanically unstable after a certain operating time.

It is therefore an object of the present invention to provide an electrolytic cell which does not have these drawbacks.

A further object of the present invention is to provide a process for the electrochemical production of alkali metal from an alkali metal amalgam employing said electrolytic cell, said process permitting energetically more favorable production of sodium than the Downs process and/or energetically more favorable production of potassium than the industrial process discussed at the outset. Moreover, the process is to be integratable into the existing coordinated arrangement of a chlor-alkali electrolysis in accordance with the amalgam process, while avoiding those drawbacks which arise in the implementation of the process according to GB 1,155,927. For this to be achieved, the following essential requirements must be met:

The alkali metal reaction on the anode side must satisfy the balance requirements of product integration with the chlor-alkali electrolysis. That means that the outflow concentration of alkali metal in the amalgam of the chlor-alkali electrolysis corresponds to the inflow concentration in the alkali metal electrolysis according to the invention. Moreover, the amounts of amalgam recirculated between chlor-alkali electrolysis and alkali metal electrolysis according to the invention must be kept to an order of magnitude which is justifiable in technical and economic terms. As a rule this is achieved if 50% of the alkali metal content of the inflowing amalgam are converted in the alkali metal electrolysis. The sodium metal in the first instance must be produced in such purity that further process steps to remove mercury can be dispensed with and the drawback of calcium contamination, which obtains in the Downs process, is avoided. The potassium metal in the first instance must be produced in such purity that further process steps to remove mercury can be dispensed with and the sodium content is lower than with the reduction using sodium, where the potassium produced in the first instance contains 1% of sodium. The process is to be capable of industrial-scale implementation and must therefore permit sufficiently high current densities and space-time yields. On the grounds of production building statics, safety, environmental protection and tied-up capital, the equipment needs to be designed so as to manage with a relatively small volume of mercury. The process is to be amenable to stable continuous operation and to tolerate without problems the customary metallic impurities encountered in industrial alkali metal amalgam. The term "alkali metal amalgam" denotes a solution, of an alkali metal in mercury, which is liquid at the reaction temperature.

The present invention therefore relates to an electrolytic cell comprising an agitated, alkali metal amalgam-containing anode, an alkali metal ion-conducting solid electrolyte and a cathode, wherein the solid electrolyte and the cathode are separated from one another by a liquid electrolyte.

The present invention also relates to a process for producing an alkali metal using said electrolytic cell.

The liquid electrolyte is expediently chosen so as to be stable with respect to alkali metal. The liquid electrolyte used is preferably not consumed in the electrolytic reaction. In a particularly preferred embodiment, the liquid electrolyte used is an electrolyte melt.

In a preferred embodiment, the present invention therefore relates to an electrolytic cell as described hereinabove, wherein the liquid electrolyte is an electrolyte melt.

Depending on which alkali metal is produced using the electrolytic cell according to the invention, different electrolyte melts are expediently employed as the liquid electrolyte. Preferential use in the electrolytic cells according to the invention is made of NaOH melts, $NaNH_2$ melts or mixtures thereof when producing sodium, and of KOH melts, $KNH_2$ melts or mixtures thereof when producing potassium.

Accordingly, the present invention relates to an electrolytic cell as described hereinabove, wherein the electrolyte melt is an NaOH melt, an $NaNH_2$ melt or a mixture of these, or is a KOH melt, a $KNH_2$ melt or a mixture of these.

In a particularly preferred embodiment, these melts or mixtures thereof are used in anhydrous form. In a further particularly preferred embodiment, the electrolyte melts used are mixtures and, again, particularly preferably anhydrous mixtures. Among these, in turn, eutectic mixtures are preferred.

Of course, it is conceivable for the liquid electrolytes to be admixed with one or more suitable additives. Examples to be mentioned here include, inter alia, additives which lower the melting point. In principle, all those melting point-lowering additives are suitable which do not interfere with the inventive use of the electrolytic cell and the inventive process. Preferred are melting point-lowering additives which, in the case of sodium production, are selected from the group consisting of NaI, NaBr, $Na_2CO_3$ and a mixture of two or more of these, and in the case of potassium production are selected from the group consisting of KI, KBr, $K_2CO_3$ and a mixture of these.

The anode compartment and cathode compartment of the electrolytic cell according to the invention are separated from one another by a helium-tight, alkali metal ion-conducting solid electrolyte. Eligible for this purpose, in the case of producing sodium, are ceramic materials such as NASICON®, whose composition is specified in EP-A 0 553 400. Also suitable are sodium ion-conducting glasses and zeolites and feldspars. In the case of potassium production, a multiplicity of materials are likewise eligible. Both the use of ceramics and the use of glasses is possible. The following materials, for example, can be considered: $KBiO_3$ (T. N. Nguyen et al., *Chem. Mater*. 1993, 5, 1273–1276), gallium oxide/titanium dioxide/potassium oxide systems (S. Yoshikado et al., *Solid State Ionics* 1992, 53–56, 754–762), aluminum oxide/titanium dioxide/potassium oxide systems and KASICON® glasses (M. Lejeune et al., *J. Non-Cryst*. Solids 1982, 51, 273–276).

Preference is given to sodium β"-aluminum oxide, sodium β-aluminum oxide and sodium β/β"-aluminum oxide, and to potassium β-aluminum oxide, potassium β-aluminum oxide and potassium β/β"-aluminum oxide.

The present invention therefore also relates to an electrolytic cell as described hereinabove, wherein the solid electrolyte is selected from the group consisting of sodium β-aluminum oxide, sodium β-aluminum oxide and sodium β/β"-aluminum oxide or from the group consisting of potassium β-aluminum oxide, potassium β"-aluminum oxide and potassium β/β"-aluminum oxide.

Potassium β"-aluminum oxide, potassium β-aluminum oxide and potassium β/β"-aluminum oxide can be prepared, starting from sodium β-aluminum oxide, sodium β-aluminum oxide or sodium β/β"-aluminum oxide by cation exchange.

Expediently, the solid electrolyte is in the form of a thin-walled, yet pressure-proof, unilaterally closed tube (EP-B 0 424 673), onto whose open end an electrically insulating ring has been applied by means of a helium-tight, likewise electrically insulating glass solder joint (GB 2 207 545, EP-B 0 482 785). The wall thickness of the alkali metal ion-conducting electrolyte is generally in the range of from 0.3 to 5 mm, preferably in the range of from 1 to 3 mm, particularly preferably in the range of from 1 to 2 mm.

The cross-sectional shape of the unilaterally closed tube is circular in the preferred embodiment. Also conceivable, however, are cross-sectional shapes having an enlarged surface area, which can be derived, for example, from a composite of a plurality of circular areas.

The design of the alkali metal ion-conducting solid electrolytes in terms of its leakproofness crucially affects the process according to the invention, as the only way for mercury to pass into the liquid electrolyte and consequently into the alkali metal produced is via leaks in the solid electrolyte or sealing system, since the anode potentials in the process according to the invention are adjusted so as to preclude any formation of mercury ions.

As a rule, solid electrolytes are used which in a helium leak test exhibit leakage rates of less than $10^{-9}$ (mbar·1)/s, i.e. are helium-tight within detectability limits.

Furthermore, the design of the releasable sealing joints is such that the liquid electrolyte and amalgam are each sealed with respect to the ambient atmosphere. Releasable seals between liquid electrolyte and amalgam are avoided as far as possible, since the releasable seals as a rule are liquid-tight, but not gas-tight.

In a preferred embodiment, the releasable sealing joints used are flat gaskets, preferably made of graphite, for example of non-reinforced GRAPHIFLEX®. In a preferred embodiment, the seals have an inert gas such as argon or nitrogen flowing around them, to prevent oxygen from diffusing through. Using helium-tight electrolytes and the sealing arrangement specified, alkali metals with a residual level of mercury in the range of from 0.05 to 0.3 ppm are obtained.

The geometry of the solid electrolyte can essentially be chosen at will and be tailored to specific process conditions. In a preferred embodiment, the solid electrolyte, as mentioned above, is in the form of a unilaterally closed tube. In a more preferred embodiment, said tube on its outside is in contact with the anode. This anode compartment is more preferably delimited on its outside by an outer tube which is fabricated from a material which is highly impervious and resistant to hot amalgam. Potentially suitable materials, in particular, are alloy steel and graphite. In a more preferred embodiment, the material chosen is alloy steel.

The outer tube may essentially have any cross section. Preferably, an outer tube is used which is concentric with the solid electrolyte tube.

Within the scope of the process according to the invention, the annular gap between outer tube and ceramic tube is perfused in the longitudinal direction by the liquid anode. In this arrangement, the annular gap, as mentioned above, has a preferred gap width of from 1 to 10 mm. More preferably, the annular gap has a width in the range of from 2 to 5 mm, particularly preferably a width in the range of from 2.5 to 3 mm.

Accordingly, the present invention relates to an electrolytic cell as described hereinabove, wherein the solid electrolyte is fashioned as a unilaterally closed tube which is mounted inside a concentric alloy steel tube in such a way as to produce an annular gap having a gap width in the range of from 1 to 10 mm.

The process according to the invention is operated in an electrolytic cell comprising an agitated liquid alkali metal amalgam anode. This involves an agitated liquid anode which during operation is depleted with respect to its alkali metal content, so that it can be replaced by alkali metal-richer amalgam which can be obtained in a standard-operation amalgam cell of a chlor-alkali production system or by electrolysis of sodium salts or potassium salts with an Hg or amalgam cathode such as e.g. NaOH or KOH.

This can be effected in a technically simple manner, since the liquid alkali metal amalgam can be delivered without any problems. As a rule, the concentrated amalgam outflow of a standard-operation amalgam cell is heated, in a heat exchanger, to the operating temperature of the process according to the invention and is fed to the hot, agitated liquid anode. Expediently, this is done in such a way in a countercurrent heat exchanger that the depleted amalgam discharged at high temperature heats the feed.

The replacement of depleted amalgam can be effected either batchwise or continuously, with the continuous process being operationally simpler to implement. The drawback that, as a rule, the inflowing concentrate is diluted by recirculated, already depleted alkali metal amalgam can be compensated for by the process being implemented as a multistage process.

The liquid anode is expediently agitated by stirring and/or by means of a pump in a circuit under atmospheric pressure or slight positive pressure. The agitation caused by the reaction-related exchange of amalgam and/or the thermal convection are negligible compared with the agitation demanded in the inventive process and are not sufficient for achieving the preferred current densities.

If the liquid anode, as described in GB 1,155,927, is operated without agitation, current densities of no more than from 40 to 70 $A/m^2$ can be achieved. Increasing the cell voltage results only in an insignificant increase in the current density, as the resistance of the cell increases with increasing current density. Surprisingly, at moderate cell voltages, i.e. cell voltages in the range of from 0.9 to 1.6 volts for sodium amalgam, and from 0.95 to 2.1 volts for potassium amalgam, current densities of from 250 to 3000 $A/m^2$ are achieved if the anode is agitated.

Accordingly, the present invention also relates to a process as described hereinabove, which is carried out at a current density greater than 250 $A/m^2$.

The agitation of the anode is effected, for example, via stirring by gas, for example, being bubbled in or via a mechanical stirrer or by means of a pump. Preference is given to agitation in the form of forced flow, as can be achieved, for example, by means of an amalgam circuit driven by a pump.

The flow velocity is generally in the range of from 0.03 to 1.0 m/s, preferably in the range of from 0.05 to 0.6 m/s and particularly preferably in the range of from 0.1 to 0.3 m/s. A higher flow velocity, as a rule, permits higher current densities. A further design-related advantage of the anode in the form of an annular gap resides in the relatively small anode volume, relative to the anode area. This makes it possible to meet the requirement of moderate apparatus weight and acceptable mercury circulation capacity.

The cathode material used in the cell according to the invention can essentially be any suitable material. Examples of these include, inter alia, steel, pure nickel of e.g. DIN material number 2.4066 or electrode graphite. In a preferred design of the cell according to the invention, the cathode is fabricated from steel.

Accordingly, the present invention also relates to an electrolytic cell as described hereinabove, wherein the cathode is a steel cathode.

Suitable steels include e.g. alloy steel, austenitic steel or unalloyed steel. Preferred austenitic steels to be mentioned include, inter alia, the steels having the DIN material numbers 1.4541 or 1.4571, preferred unalloyed steels include the steels having the DIN material numbers 1.0305 or 1.0346. In an especially preferred embodiment of the electrolytic cell according to the invention, unalloyed steels are used.

In a more preferred embodiment, the cathode is fashioned as a rod which is mounted in the solid electrolyte, fashioned as a tube. Preferably, the rod is mounted in such a way as to produce, between the solid electrolyte and the rod, a gap having a gap width in the range of from 1 to 6 mm.

Accordingly, the present invention also relates to a cell, as described above, wherein the steel cathode is fashioned as a rod which is mounted in the solid electrolyte, fashioned as a tube, in such a way as to produced, between the inner wall of the solid electrolyte and the rod, a gap having a gap width in the range of from 1 to 6 mm.

Of course, the cathode in the cell according to the invention can alternatively have any other suitable geometry. For example, it can be fashioned as a tube, as a wire mesh or as an expanded metal.

The solid cathode in the process according to the invention is the site where the alkali metal is produced. The latter rises in the liquid electrolyte along the cathode fashioned as a rod according to the preferred embodiment and can be drawn off as a pure metallic phase.

When operating the process according to the invention, it is likewise absolutely necessary to preclude any exposure of the alkali metal ion-conducting ceramics to water vapor. This is achieved, as a rule, by heating the amalgam which carries traces of water, discharging the water vapor and only then feeding the anhydrous amalgam/mercury mixture to the liquid anode. Discharge of the water vapor is expediently aided by stripping with inert gas or applying negative pressure.

The present invention further relates to a process as described hereinabove which is carried out at a temperature in the range from 260 to 400° C.

The current density is generally from 0.5 to 10 $kA/m^2$, preferably from 1.0 to 3 $kA/m^2$ (sodium) or from 0.3 to 3 $kA/m^2$, preferably from 0.5 to 1.5 $kA/m^2$ (potassium). The current density is set in a controlled manner at the external current source, which as a rule is a mains rectifier.

In a special embodiment, the electrolytic cell according to the invention is integrated into the power supply of an amalgam-producing chlorine cell, thus making it possible to dispense with an additional mains rectifier.

When the alkali metal ion-conducting solid electrolytes are used for the first time, an excessively high ceramic resistance is often observed, which remains as high as ever in the course of further operation. The resistance of the solid electrolyte can be higher by a factor of up to 30 than the achievable values. This can probably be attributed to the surface being insufficiently reactive, this being caused by the exposure to water in form of the water content of the ambient air. This damage can take place, in particular, when the ceramics are stored or during assembly. After sintering, the ceramic tubes are therefore expediently packaged under vacuum in diffusion-tight aluminum/plastic composite foils.

The ceramic tubes in their original packaging are stored by enclosing them in tightly sealed, argon-filled metal containers.

In a further preferred embodiment of the process according to the invention, the solid electrolyte is conditioned in order thus to effect a reduction in its resistance.

Accordingly, the present invention also relates to a process as described hereinabove, wherein the solid electrolyte is conditioned before the process is carried out.

Conceivable conditioning methods, inter alia, involve treating the solid electrolyte, before and/or after mounting in the electrolytic cell, with one or more chemical compounds in order thus to apply, for example, one or more ion-conducting layers. In principle, any suitable chemical compounds are conceivable for this purpose.

If sodium is being produced in the process according to the invention it is possible, for example, to treat the solid electrolyte with NAOH, $NaNH_2$, NaOR or a mixture of two or more of these. If potassium is being produced in the process according to the invention it is possible, for example, to treat the solid electrolyte with KOH, $KNH_2$, KOR or a mixture of two or more of these. Here, R denotes a straight-chain or branched-chain alkyl radical having from 1 to 5 carbon atoms. Equally, R can denote a suitable aryl or aralkyl radical which may or may not be suitably substituted.

Accordingly, the present invention also relates to a process as described hereinabove, wherein the solid electrolyte is conditioned with NaOH, $NaNH_2$, NaOR or a mixture of two or more of these, or with KOH, $KNH_2$, KOR or a mixture of two or more of these, where R denotes a straight-chain or branched-chain alkyl radical having from 1 to 5 carbon atoms.

One conceivable approach among others in this context is to treat the solid electrolyte with a melt, with an alcoholic solution and/or with an aqueous solution of the abovementioned compounds.

Accordingly, the present invention also relates to a process as described hereinabove, wherein NaOH, $NaNH_2$, NaOR or the mixture of two or more of these, or KOH, $KNH_2$, KOR or the mixture of two or more of these are employed as a melt or/and as an aqueous solution or/and as an alcoholic solution.

If the solid electrolyte in a preferred embodiment is fashioned as a tube, it is possible to condition one side or both sides of the tube by a treatment with these chemical compounds. Of course, it is also possible to condition the solid electrolyte a number of times in two or more steps, with the option of the chemical compound or the mixture of two or more of these being identical or different in the individual conditioning steps.

A further option of conditioning the solid electrolyte and reducing the ceramic resistance is to operate the cell initially at reverse polarity, i.e. initially to operate the anode as the cathode and the cathode as the anode. The cathode in this case can consist of sodium amalgam and mercury, like the anode under normal conditions. The current density in the reverse-polarity state is increased linearly from 50 $A/m^2$ to 3000 $A/m^2$ (sodium) , or from 30 $A/m^2$ to 1000 $A/m^2$ (potassium) over a period of from 1 to 44 h, preferably from 2 to 6 h.

The lowest ceramic resistances are achieved if, during start-up, over a period of from 1 to 24 hours at an operating temperature of from 300 to 350° C. (sodium) or 250 to 350° C. (potassium), liquid alkali metal is initially used as the anode, which is then replaced by amalgam. This conditioning embodiment is particularly preferred.

Of course, it is also possible for the abovementioned types of conditioning to be carried out in combination with one another, all possible combinations being conceivable.

In a preferred procedure, the current direction is operated with reverse polarity for from 1 to 10 minutes at a time, at intervals of from 1 to 24 hours, by anode and cathode being short-circuited via an external resistor rated such that the current intensity when polarity is reversed corresponds to about 1.5 times the operational current intensity. The yield of alkali metal obtained is exhaustive in the process according to the invention, based on the alkali metal reacted on the anode side. The current yield of alkali metal obtained, in the case of normal-polarity mode, is 100% within measurement accuracy. Reversing the polarity at intervals reduces the mean current yield to values in the range of from 95 to 98%.

The amalgam fed to the anode is depleted, in a preferred embodiment, from 0.4 wt % to 0.1 wt % of alkali metal. The unreacted alkali metal is not lost if the process is coupled to a chlor-alkali electrolysis, as it is recycled into the chlor-alkali cell and thence returns via the amalgam circuit.

The present invention therefore also relates to an integrated process for producing chlorine and alkali metal, starting from alkali metal chloride, which comprises the following steps (i) and (ii):

(i) performing a chlor-alkali electrolysis to obtain elemental chlorine and alkali metal amalgam;

(ii) performing a process as described above to obtain alkali metal.

Figure 2:
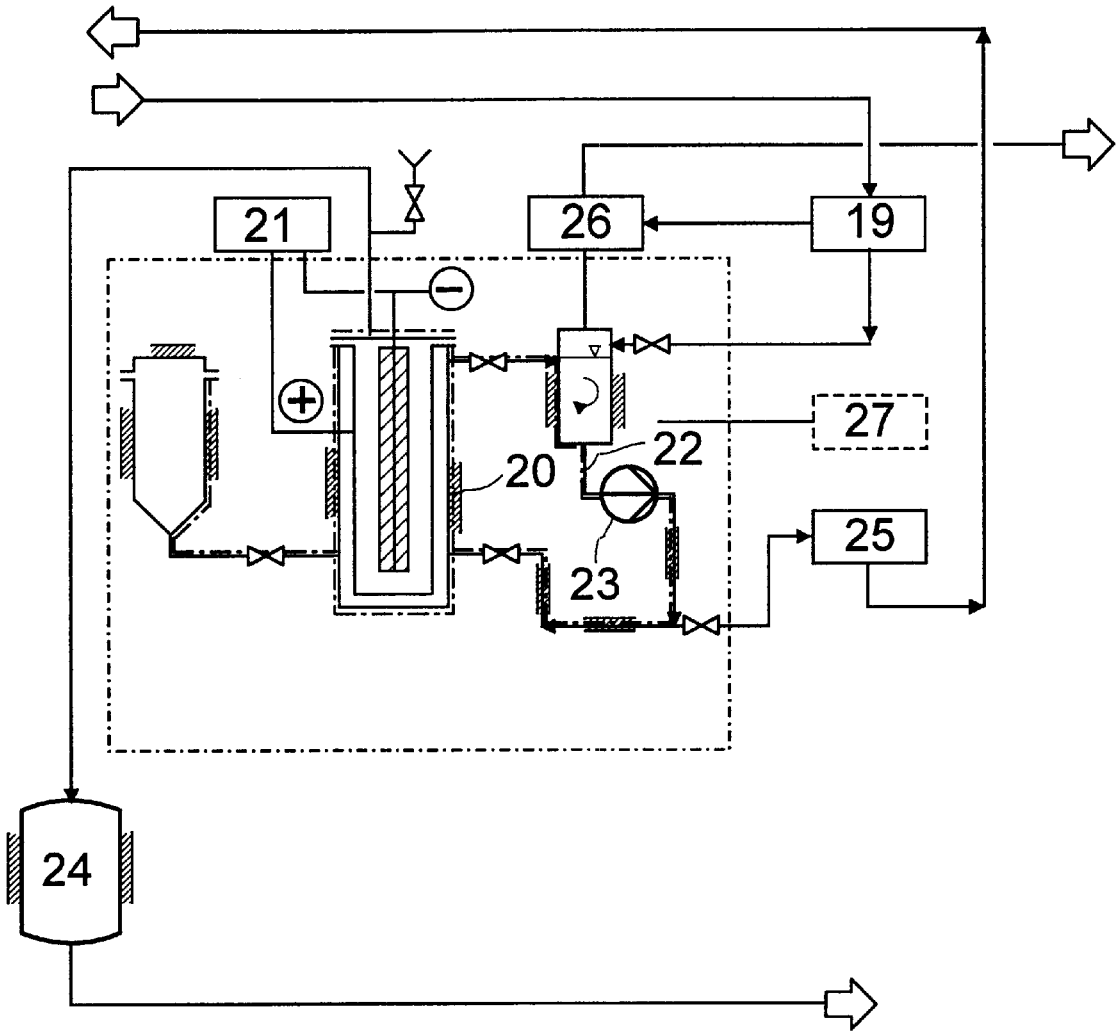

The following example illustrates the invention. This example refers to the two FIGS. 1 and 2 accompanying the present application, in which FIG. 1: shows a schematic depiction of an electrolytic cell according to the invention, comprising a unilaterally closed, tubular solid electrolyte which is mounted within a concentric alloy steel tube, the tubular solid electrolyte in turn having a rod-shaped alloy steel electrode mounted therein;

FIG. 2: shows a schematic depiction of an apparatus designed for continuous operation, mounted within which is the electrolytic cell according to the invention.

EXAMPLE

Apparatus (FIG. 1)

The cell according to FIG. 1 in its core consisted of a unilaterally closed tube (1) of β"-aluminum oxide (external diameter 32 mm, length 210 mm, wall thickness 1.7 mm). Fitted helium-tightly by means of a glass solder joint at the open end was a ring of α-aluminum oxide (2). By means of this ring (2) the sodium ion-conductive tube of β"-aluminum oxide had been mounted, with its opening at the top, within a concentric alloy steel tube (3) (having an internal diameter of 37 mm and a length of about 215 mm). The internal diameter of the steel tube had been tailored to the external diameter of the ceramic tube so as to result n an annular gap having a gap width of 2.5 mm. The anode compartment, defined via the annular gap and the lube length firstly met the requirement of a design -which was able to manage with a relatively small mercury volume. Secondly, the annular cross section permitted a highly effective, in terms of current density, perfusion of the anode compartment in the axial direction. For sealing purposes, the ring of a-aluminum oxide (2), together with one flat gasket each as the bottom (4) and the top (5) via the housing flange (6) and the cover flange (7), was pressed together with four clamping screws (8).

The alloy steel container was fitted with an anode current feed (9). Welded on were a branch piece (10), laterally at the bottom for supplying amalgam, and a branch piece (11), laterally at the top for discharging it. From the cover flange, an alloy steel rod (18) projected as the cathode into the orifice of the tube made of β"-aluminum oxide.

Recessed into the cover flange was a separation chamber in which the molten sodium separated, under the influence of gravity, from the heavier electrolyte melt.

A pipe (13) was run through the cover flange and served for the free discharge of liquid sodium. Optionally, the cell could be wrapped in electric heating tapes (14) and be insulated, or it could be mounted, together with a plurality of cells, within a heated chamber.

The liquid sodium formed was discharged under pressure produced as a result of the reaction via the heated outflow pipe (13) into an inerted vessel partly filled with paraffin oil, where it solidified in the form of small spheres in the paraffin oil.

The electrolytic cell was integrated into an apparatus designed for continuous operation and having the following functions (FIG. 2).

Continuous supply (19) with dry preheated Na-rich amalgam.

Heater (20) designed for heating in the range of from 310° C. to 360° C.

DC supply (21).

Defined flow velocity in the anode by means of an internal, pump (23) driven amalgam circuit (22), continuously adjustable in the range of from 0.02 to 0.8 m/s.

Offtake of liquid sodium (24).

Continuous disposal of low-Na amalgam (25).

Offgas treatment (26).

Safety monitoring, especially regarding Hg emission (27).

Experiment

Mounting of the commercially available tube of sodium β"-aluminum oxide took place without delay in the course of one hour in laboratory atmosphere after it had been removed from a vacuum package. Then both chambers of the cell were flooded with argon and the cell was sealed. It was mounted in the apparatus 2 to 5 days later.

The apparatus was heated to 330° C., raising the temperature at a rate of 20° C./h. Then the cathode compartment within the unilaterally closed ceramic tube was charged, via a supply line, with an externally fused melt of 60 wt % of $NaNH_2$ and 40 wt % of NaOH. The anode compartment outside the ceramic tube was charged with liquid sodium. Over a period of 35 minutes, the current intensity was increased, once only, from 5 A to 40 A in steps of 5 A at a time and then maintained at 40 A over a period of 4 hours.

After 4 hours, the voltage/current ratio had settled at 0.18 V/40 A. Then the anode compartment was emptied and the amalgam circuit was charged with 39 kg of amalgam. The contents of the amalgam circuit were heated to 330° C. while the pump was switched off. Then the circuit was powered up. In the process, the sodium still present in the anode compartment was flushed out and dispersed in the amalgam itself.

This first charge was discarded and the circuit was replenished with fresh amalgam heated to 330° C. with a sodium fraction of 0.4 wt %. A mean flow velocity of 0.3 m/s was set, corresponding to a circulating volume flow of 0.29 $m^3$/h.

In the de-energized state, a cell voltage of 0.82 V established itself. The output voltage of a DC power supply unit was limited to 2 volts and the circuit comprising the cell was closed, involving a linear increase in the current from 0 A to 40 A over a period of 3 hours. Then, at intervals of 30 min, 7.8 kg of amalgam at a time were discharged from the circuit contents and replaced by fresh amalgam. In the process, the cell voltage was observed to fluctuate between values in the range from 1.5 to 1.7 volts.

From a current of 40 A with an anode area of 200 $cm^2$, a current density of 2000 A/$M^2$ was calculated. This was twice as high as that required for industrial utilization of the process.

Sodium was being discharged steadily. The sodium discharge and the depletion of the amalgam agreed with Faraday's law. The experiment remained stable owner a period of at least 4000 hours of operation.

We claim:

1. An electrolytic cell comprising an agitated, alkali metal amalgam-containing anode, an alkali metal ion-conducting solid electrolyte and a cathode, wherein the solid electrolyte and the cathode are separated from one another by a liquid electrolyte.

2. The electrolytic cell as claimed in claim 1, wherein the liquid electrolyte is an electrolyte melt.

3. The electrolytic cell as claimed in claim 2, wherein the electrolyte melt is an NaOH melt, an $NaNH_2$ melt or a mixture of these, or is a KOH melt, a $KNH_2$ melt or a mixture of these.

4. The electrolytic cell as claimed in claim 1, wherein the solid electrolyte is selected from the group consisting of sodium β-aluminum oxide, sodium β"-aluminum oxide and sodium β/β"-aluminum oxide or from the group consisting of potassium β-aluminum oxide, potassium β"-aluminum oxide and potassium β/β"-aluminum oxide.

5. The electrolytic cell as claimed in claim 1, wherein the solid electrolyte is fashioned as a unilaterally closed tube which is mounted inside a concentric alloy steel tube in such a way as to produce an annular gap having a gap width in the range of from 1 to 10 mm.

6. The electrolytic cell as claimed in claim 1, wherein the cathode is a steel cathode.

7. The electrolytic cell as claimed in claim 5, wherein the cathode is a steel cathode which is fashioned as a rod which is mounted in the solid electrolyte in such a way as to produce, between the inner wall of the solid electrolyte and the rod, a gap having a width in the range of from 1 to 6 mm.

8. A process for producing an alkali metal using an electrolytic cell as claimed in claim 1.

9. The process as claimed in claim 8, which is carried out at a current density greater than 250 A/$m^2$.

10. The process as claimed in claim 8, which is carried out at a temperature in the range from 260 to 400°C.

11. The process as claimed in claim 8, wherein the solid electrolyte is conditioned.

12. The process as claimed in claim 11, wherein is solid electrolyte is conditioned with NaOH, $NaNH_2$, NaOR or a mixture of two or more of these, or with KOH, $KNH_2$, KOR or a mixture of two or more of these, where R denotes a straight-chain or branched-chain alkyl radical having from 1 to 5 carbon atoms.

13. The process as claimed in claim 12, wherein NaOH, $NaNH_2$, NaOR or the mixture of two or more of these, or KOH, $KNH_2$, KOR or the mixture of two or more of these are employed as a melt or/and as an aqueous solution or/and as an alcoholic solution.

14. An integrated process for producing chlorine and alkali metal, starting from alkali metal chloride, which comprises the following steps (i) and (ii):

(i) performing a chlor-alkali electrolysis to obtain elemental chlorine and alkali metal amalgam;

(ii) performing a process as claimed in claim 8 to obtain alkali metal.

* * * * *